US007168118B2

(12) United States Patent
Kim et al.

(10) Patent No.: US 7,168,118 B2
(45) Date of Patent: Jan. 30, 2007

(54) METHOD FOR CONTROLLING SPINNING SPEED IN DRUM-TYPE WASHING MACHINE

(75) Inventors: Jea-Kyum Kim, Kimhae-shi (KR); Ho-Cheol Kwon, Changwon-shi (KR); Jong-A Park, Changwon-shi (KR); Kang-Mo Choi, Masan-shi (KR); Kweon Son, Changwon-shi (KR)

(73) Assignee: LG Electronics Inc., Seoul (KR)

( * ) Notice: Subject to any disclaimer, the term of this patent is extended or adjusted under 35 U.S.C. 154(b) by 294 days.

(21) Appl. No.: 10/433,158

(22) PCT Filed: Nov. 30, 2001

(86) PCT No.: PCT/KR01/02075

§ 371 (c)(1),
(2), (4) Date: May 30, 2003

(87) PCT Pub. No.: WO02/44459

PCT Pub. Date: Jun. 6, 2002

(65) Prior Publication Data

US 2004/0019979 A1 Feb. 5, 2004

(30) Foreign Application Priority Data

Dec. 1, 2000 (KR) ..... 2000-72545

(51) Int. Cl.
*D06F 33/00* (2006.01)

(52) U.S. Cl. ..... 8/159; 68/12.16; 68/12.06; 68/12.02; 8/158

(58) Field of Classification Search ..... 8/159, 8/158; 68/12.06, 12.16, 23.2, 12.02
See application file for complete search history.

(56) References Cited

U.S. PATENT DOCUMENTS 3,596,159 A * 7/1971 Kato ..... 318/799
3,612,970 A * 10/1971 Sofan ..... 318/721
4,150,303 A * 4/1979 Armstrong ..... 307/140
4,284,932 A * 8/1981 Kawada et al. ..... 388/804

(Continued)

FOREIGN PATENT DOCUMENTS

EP 0 313 339 A1 4/1989

(Continued)

*Primary Examiner*—Alexander Markoff
*Assistant Examiner*—Sarah E. Husband
(74) *Attorney, Agent, or Firm*—McKenna Long & Aldridge LLP

(57) ABSTRACT

Object of the present invention lies on improving a system stability by reducing an allowable eccentricity of laundry below a preset value when a spinning speed reaches to a maximum even if a voltage higher than a rated voltage is applied, by varying a maximum limit of a lead angle with a voltage applied to a drum type washing machine. For achieving the object of the present invention, in a method for controlling a spinning speed of the present invention, a maximum value of a lead angle is set to vary with an applied voltage after detection of the applied voltage.

6 Claims, 4 Drawing Sheets

U.S. PATENT DOCUMENTS 4,451,823 A * 5/1984 Penn et al. ..... 340/648
4,481,786 A * 11/1984 Bashark ..... 62/160
4,633,158 A * 12/1986 Hirata et al. ..... 318/723
4,734,631 A * 3/1988 Kamikura et al. ..... 318/685
4,765,161 A 8/1988 Williamson
4,767,975 A * 8/1988 Unsworth ..... 318/729
5,471,127 A * 11/1995 Vaughan et al. ..... 318/809
5,507,054 A * 4/1996 Blauert et al. ..... 8/159
5,507,055 A * 4/1996 Blauert et al. ..... 8/159
5,767,653 A * 6/1998 DeFiore et al. ..... 318/811
5,808,441 A * 9/1998 Nehring ..... 318/751
5,875,103 A * 2/1999 Bhagwat et al. ..... 363/17
6,029,300 A * 2/2000 Kawaguchi et al. ..... 8/159

FOREIGN PATENT DOCUMENTS

EP 0 657 576 A1 6/1995
JP 54-50825 A * 4/1979
JP 8-107675 A * 4/1996
KR 1996-0034546 10/1996
KR 1999-0075671 10/1999
SU 635591 A * 11/1978

* cited by examiner

FIG. 4

| the persent invention | | | related art |
|---|---|---|---|
| voltage range | maximum limited angle | allowable eccentricity when a maximum speed is reached | allowable eccentricity at a maximum limit angle of 65° (regardless of the voltage) |
| below 210 | 63 | 290g | 215g |
| 211~220v | 60 | 300g | 265g |
| 221~230v | 57 | 295g | 290g |
| 231~240v | 55 | 300g | 320g |
| 241~250v | 50 | 300g | 420g |
| 251~260v | 48 | 300g | 570g |
| over 261 | 47 | 300g | 750g |

METHOD FOR CONTROLLING SPINNING SPEED IN DRUM-TYPE WASHING MACHINE

TECHNICAL FIELD

The present invention relates to a method for controlling a spinning speed of a drum washing machine, and more particularly, to a method for controlling a spinning speed of a drum washing machine, in which an upper limit of a lead angle is made to vary with a voltage applied to the washing machine, to control an allowable eccentricity of laundry at a maximum speed to be below a preset value, for securing a system stability.

BACKGROUND ART

In general, in the washing machine, there are a pulsator type washing machine in which a washing tub rotates in a vertical position, and a drum type washing machine in which the washing tub rotates in a horizontal position.

Particularly, the drum washing type, carrying out washing by using a friction of laundry and a drum rotated as a driving power of a motor is received, gives almost no damage to the laundry, causes no entangling of the laundry, and can provide pounding and rubbing effects.

One exemplary related art direct coupling type drum washing machine will be explained, with reference to FIG. 1, briefly. FIG. 1 illustrates a section of one exemplary related art direct coupling type drum washing machine, provided with a tub 3 inside of a cabinet 5, and a drum 9 inside of the tub 3.

There is a drum shaft 13 fitted to the drum 9 for transmission of a driving power of the motor 6 to the drum 9. There are bearings 12 in front and rear of the drum shaft 13, and a bearing housing in a central part of a rear wall of the tub 3. There is a stator 7 of the direct coupling type motor 6 fixed to a rear wall part of the tub 3 and a rotor 8 of the direct coupling type motor 6 on the drum shaft 13 together with the stator 7. According to this, the drum 9 is directly coupled to, and rotated with the rotor 8.

In the meantime, there is a door 1 in front part of the cabinet 5, and there is a gasket 2 between the door 1 and the tub 3. There are hanging springs 4 between an inside of an upper part of the cabinet 5 and an upper side of an outside circumference of the tub 3 for supporting the tub 3, and there is a friction damper 10 between an inside of a lower part of the cabinet 5 and a lower side of an outside circumference of the tub 3, for attenuating vibration of the tub 3 occurred during spinning. There is a motor sensor 11 at one side of the motor 6 for detection of a revolution speed of the rotor 8.

In the meantime, in the foregoing direct coupled drum washing machine, revolution speed control of the drum 9 is carried out during spinning as follows. When the rotor 8 starts to rotate as the spinning starts, the motor sensor 11 keeps to detect a revolution speed of the rotor 8, and transmits to a controller (not shown), and the controller compares if the revolution speed of the rotor 8 is reached to a desired revolution rate.

If the revolution speed of the rotor 8 is reached to a revolution speed (for an example, 110 rpm) the laundry is stuck to, and does not fall off from, an inside wall of the drum 9, an eccentricity of the laundry is detected, and if the eccentricity is determined to be higher than an allowable value, the drum is rotated again after the drum is stopped, and if the eccentricity is determined to be lower than an allowable value, the revolution speed of the rotor 8 is increased gradually.

That is, because rotation of the drum 9 under a state the eccentricity is excessive at an initial spinning affects to a general rigidity of the system, such as breaking the bearing 12 supporting the drum shaft 13 or breaking the tub 3, a full scale spinning is progressed after the eccentricity is controlled under a preset value.

On the other hand, if the eccentricity is determined to be below the allowable value, the revolution speed of the rotor 8 is increased step by step until the revolution speed reached to a maximum spinning speed, when the revolution speed of the rotor 8 is increased no more, but is maintained.

In the increase of the revolution speed of the rotor 8 to the maximum revolution speed for progressing spinning, the revolution speed of the rotor 8 is controlled by means of a duty value and a lead angle.

At first, the duty value is increased by PWM (Pulse Width Modulation) to a revolution speed (for an example, 1000 rpm) below the maximum revolution speed (for an example, 1400 rpm), and remained portion of the revolution speed required to reach to the maximum revolution speed is increased by controlling the lead angle for bringing the revolution speed into line with a desired maximum revolution rate.

The control of the motor 6 speed by controlling the duty value and the lead angle is made as follows.

At first, the duty value, varied by PWM control, is a value varied up to 0–250, and the revolution speed of the rotor 8 is varied with the value, such that the greater the duty value, the higher the revolution of the rotor. The lead angle controls a spinning speed by controlling a phase difference of a current and a voltage, of which purpose lies on bringing waveforms of the voltage and the current into conformity by making the voltage applied earlier than the current within 0–75° phase taking a fact that the phase of the current is later than the voltage into account, and it is favorable that the waveforms of the voltage and the current are in conformity in view of power consumption.

However, the related art direct coupling type drum washing machine has the following problems in the method for controlling the spinning speed.

That is, though the process proceeds to a high speed spinning as the eccentricity is detected to be below a present value at an initial detection of the eccentricity, if an eccentricity greater than a preset value is actually occurred due to change of the eccentricity during the spinning, or inaccurate detection of the initial eccentricity, the spinning is progressed as the lead angle increases gradually until the present maximum revolution speed is reached.

Once this happens, because it is dangerous as an excessive force is applied to an entire system, such as a heavy load being applied to the motor 6, it is designed that a maximum value of the lead angle is controlled to be below a preset value (for an example; 65°).

However, in the related art, not only the maximum lead angle value is fixed as one value, but also the lead angle value is set to a value greater by a certain extent than an actual lead angle required for reaching to the maximum spinning speed when the rated voltage and eccentricity are normal.

When the lead angles are the same, the spinning revolution speed is varied with the applied voltage, such that the higher the applied voltage, the higher the spinning revolution rate.

Accordingly, in the related art as shown in FIG. 4, when a voltage higher than the rated voltage is applied under a state when both the lead angle and the load are the same, the allowable eccentricity for reaching to the maximum speed of the drum 9 becomes also greater because the revolution speed of the rotor 8 and the drum 9 directly coupled thereto become the higher compared to a case the rated voltage is applied.

However, if the eccentricity is greater than a certain amount (for an example, 300 g) under a state the drum 9 is reached to the maximum revolution speed, an excessive load is applied to the entire washing machine system due to the excessive eccentricity over the regular allowable value, which at the end weakens a rigidity as an overstrain is given to the entire system, such as motor, and the like.

In the meantime, in the related art as shown in FIG. 4, there has been a disadvantage that the maximum spinning speed can not be reached even if the lead angle is increased up to a maximum lead angle despite of a small eccentricity though the applied voltage is low.

DISCLOSURE OF INVENTION

An object of the present invention is for achieving a system stability improvement in a drum washing machine by reducing an eccentricity of laundry allowed when a maximum spinning speed is reached to be below a preset value even if a voltage higher than a rated voltage is applied, by designing an upper limit of the lead angle to be varied with the applied voltage.

To do this, the present invention provides a method for controlling a spinning speed of a drum washing machine characterized in that a received voltage is sensed, and a maximum value of a lead angle is varied with a size of the received voltage.

BEST MODE FOR CARRYING OUT THE INVENTION

One embodiment of the present invention will be explained, with reference to FIGS. 3 and 4.

Figure 1:
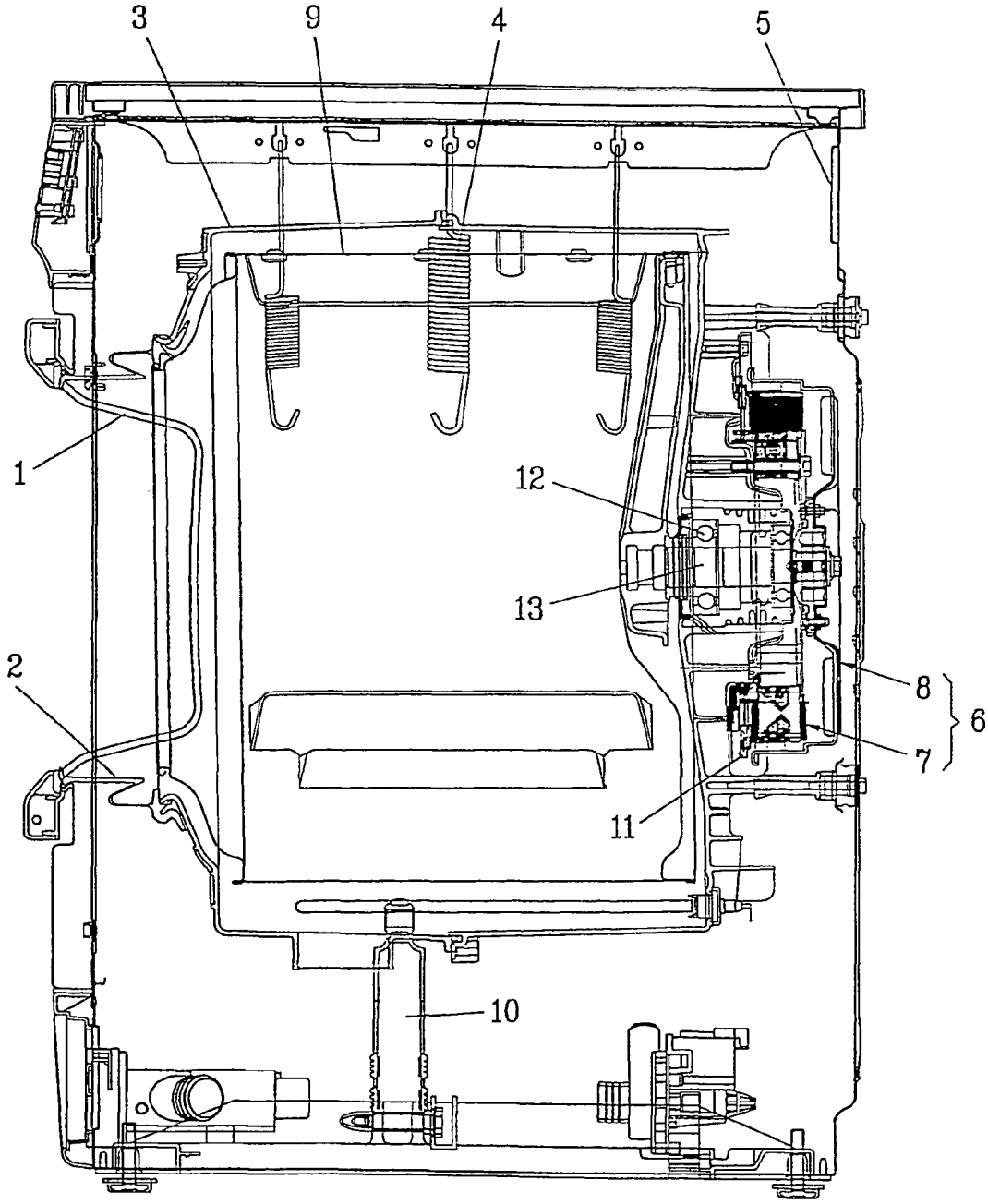
FIG. 1 illustrates a section of one exemplary related art direct coupling type drum washing machine.
Figure 2:
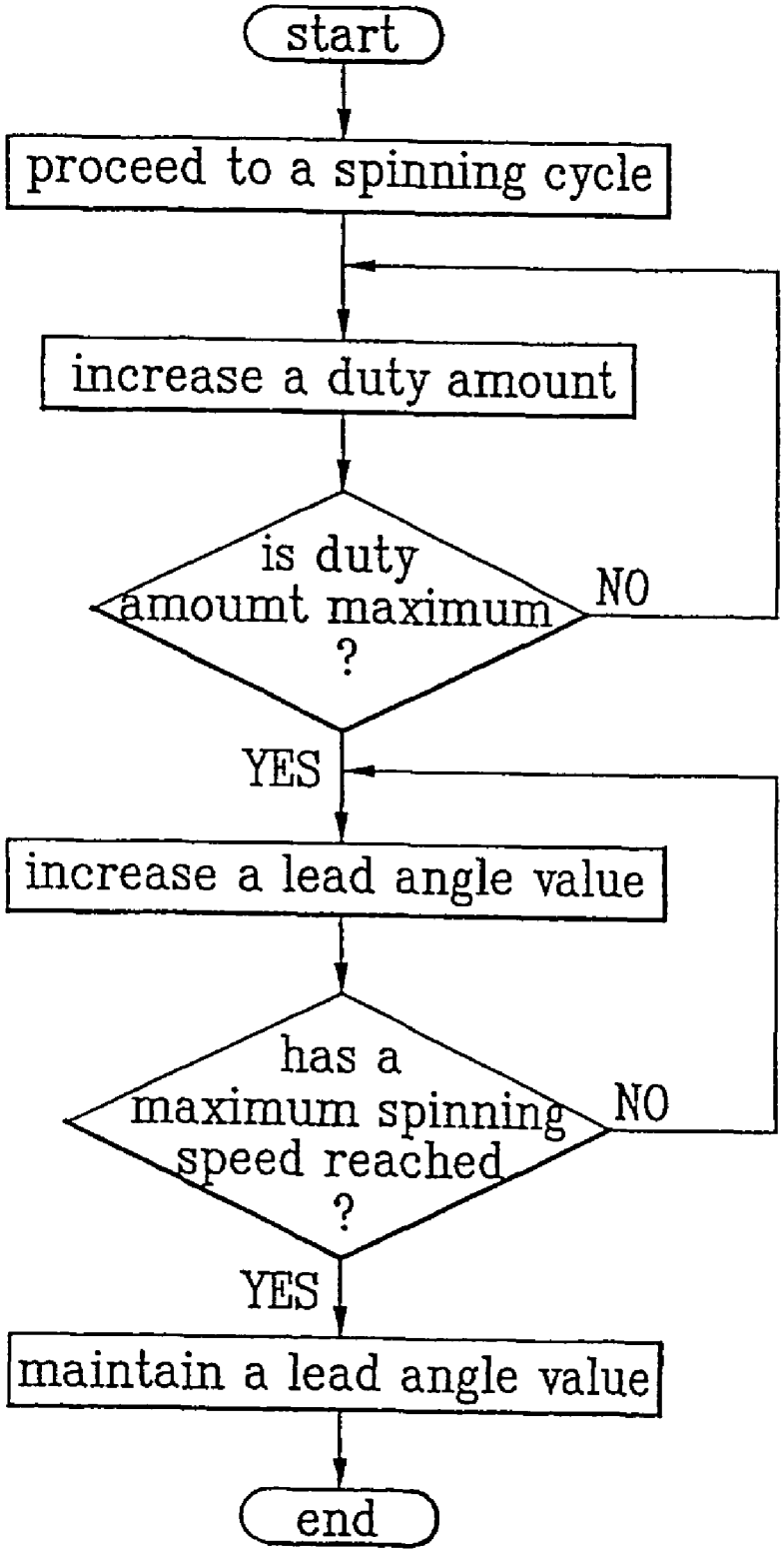
FIG. 2 illustrates a flow chart for showing the steps of a related art controlling method.
Figure 3:
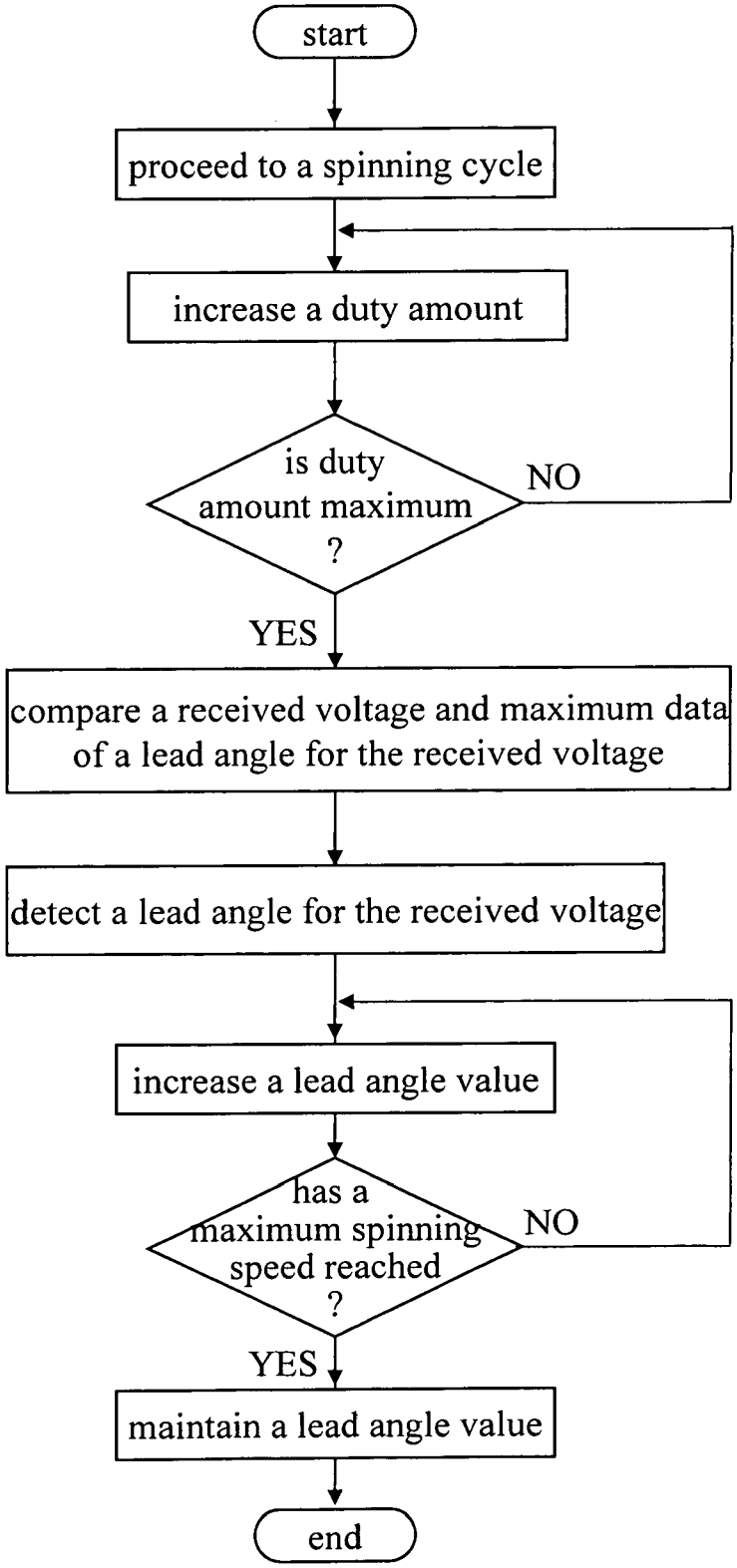
FIG. 3 illustrates a flow chart for showing the steps of a controlling method in accordance with a preferred embodiment of the present invention; and, FIG. 4 illustrates a table showing a comparison of allowable eccentricities at maximum speeds for a maximum lead angle for a voltage of the present invention and for a maximum lead angle in the related art.

FIG. 3 illustrates a flow chart for showing the steps of a controlling method in accordance with a preferred embodiment of the present invention, and FIG. 4 illustrates a table showing a comparison of allowable eccentricities at maximum speeds for a maximum lead angle for a voltage of the present invention and for a maximum lead angle in the related art. The present invention suggests sensing a received voltage and setting a maximum lead angle to be varied with the received voltage in a method for controlling a spinning speed of a drum washing machine.

When the received voltage is higher than a rated voltage, a maximum lead angle is greater than a maximum lead angle at reception of the rated voltage, and when the received voltage is lower than the rated voltage, the maximum lead angle is smaller than the maximum lead angle at reception of the rated voltage.

The method for controlling a spinning speed of a direct coupling type drum washing machine in accordance with a preferred embodiment of the present invention will be explained in detail, with reference to the flow chart in FIG. 3.

First of all, it is the same with the related art that the speed of the rotor is brought to be the same with the maximum spinning speed by increasing the duty value through PWM (Pulse Width Modulation), to increase a revolution speed of the rotor to a preset speed (for an example; 1,000 rpm) below a maximum speed (for an example; 1,400 rpm), and by increasing a remained portion for reaching to the maximum speed through controlling the lead angle.

In the meantime, in general, since the washing machine has a voltage sensing circuit for preventing an appliance from being operated in a case an irregular voltage, such as a voltage out of an operative range of the appliance, is received, the received voltage is sensed by the voltage sensing circuit and transmitted to the controller.

Then, the controller maintains, or changes, the maximum value of the lead angle according to a size of the received voltage sensed at the voltage sensing circuit.

That is, when the rated voltage is received, the spinning is progressed as the lead angle set to the rated voltage is maintained. When a voltage, higher or lower than the rated voltage, is received, the spinning is progressed in a state the value is changed to the maximum value of the lead angle for the received voltage with reference to a maximum data of lead angles set differently for voltage values (or voltage ranges).

For an example, as shown in FIG. 4, if 230V is the rated voltage, though the lead angle is 65° in the related art, in a case the rated voltage 230V is applied, the maximum value of the lead angle is 57°.

Moreover, as shown in FIG. 4, though, in a case even if the received voltage is higher than 261V in the related art, the maximum value of the lead angle is 65°, in a case the received voltage is higher than 261V in the present invention, the maximum value of the lead angle is 47°.

According to this, since the maximum value of the lead angle is 65° even in a case a voltage higher than the 261V of the rated voltage is received in the related art, which lead angle has the allowable eccentricity of 750 g that is excessive, the excessive eccentricity causes an excessive load on the entire system during the spinning maximum speed is reached.

However, since the maximum lead angle value is changed to 47° with reference to the maximum limited lead angle data for received voltages in a case when a voltage higher than the 261V is received in the present invention, no excessive load is applied to the entire system because the allowable eccentricity is below 300 g at the time of the maximum spinning speed even if the lead angle is increased to a maximum.

That is, in the present invention, maximum values of the lead angles are fixed for different voltages such that the spinning speed can reach the maximum speed only in a state the eccentricity is 300 g regardless of any received voltages, thereby applying no excessive load to the system.

Of course, the maximum value data of the lead angle set differently depending on voltages is already in the controller.

In summary, in controlling the spinning speed of a drum washing machine, the present invention senses the received voltage, and varies a maximum value of the lead angle with reference to a size of the voltage, so that the maximum load applied to an entire system, such as motor, and the like, is within a stable range even if the voltage varies.

By this, the present invention can secure a stability of system, such as motor, even if any voltage is applied thereto during spinning, because the allowable eccentricity does not exceed a preset value (for an example: 300 g) when the maximum speed is reached, leading the maximum load applied to the system, such as motor, to be always below a preset value, too.

Meanwhile, though the embodiment of the present invention takes the drum washing machine as an example, of course, the technical aspect of the present invention is applicable to other types of washing machines, such as a pulsator type, and the like.

INDUSTRIAL APPLICABILITY

As has been explained, by a maximum limited value of a lead angle is varied with a size of voltage received at a drum washing machine, the present invention makes an eccentricity of the laundry allowable at a maximum spinning speed to be below a preset value even if a voltage higher than a rated voltage is received.

Accordingly, the present invention is made to achieve system stability improvement by maintaining a load applied to the motor or the like of the drum washing machine to be below a preset value.

In the meantime, the embodiment of the present invention takes a drum washing machine as an example, the technical aspect of the present invention is of course applicable to other types of washing machines, such as a pulsator type washing machine.

What is claimed is:

1. A method for controlling a spinning speed of a washing machine comprising the steps of:

(a) sensing a received voltage;

(b) comparing the received voltage to a rated voltage; and, (c) controlling a maximum value of a lead angle for a motor to rotate a drum according to a size of the received voltage, wherein an eccentricity caused by non-uniform distribution of the laundry is maintained at a fixed level independent of the received voltage.

2. A method as claimed in claim 1, wherein the maximum value of the lead angle is changed when the size of the received voltage is larger than the rated voltage, such that the maximum value of the lead angle is greater than the maximum value of the lead angle at reception of the rated voltage.

3. A method as claimed in claim 1, wherein the maximum value of the lead angle is changed when the size of the received voltage is smaller than the rated voltage, such that the maximum value of the lead angle is smaller than the maximum value of the lead angle at reception of the rated voltage.

4. A method as claimed in claim 1, wherein a size of the maximum value of the lead angle for the received voltage varies with a difference of the received voltage and the rated voltage.

5. A method for controlling a spinning speed of a washing machine, comprising the steps of:

(a) detecting a difference between a received voltage and a rated voltage at a voltage sensing circuit;

(b) increasing a duty value up to a preset value for rotation of a motor to rotate a drum;

(c) comparing the received voltage to the rated voltage; and, (d) controlling a maximum value of a lead angle for the motor in accordance with a size of the received voltage, wherein the step for controlling a maximum value of the lead angle in accordance with a size of the received voltage, changes the maximum value of the lead angle when the size of the received voltage is larger than the rated voltage, such that the maximum value of the lead angle is greater than the maximum value of the lead angle at reception of the rated voltage, changes the maximum value of the lead angle when the size of the received voltage is smaller than the rated voltage, such that the maximum value of the lead angle is smaller than the maximum value of the lead angle at reception of the rated voltage, and makes a size of the maximum value of the lead angle for the received voltage to vary with a difference of the received voltage and the rated voltage.

6. A method for controlling a spinning speed of a washing machine, comprising:

detecting a difference between a received voltage and a rated voltage at a voltage sensing circuit;

increasing a duty value to a preset value for rotation of a motor to rotate a drum;

comparing the received voltage to the rated voltage; and controlling a maximum value of a lead angle for the motor in accordance with the received voltage, wherein the step of controlling the maximum value of the lead angle in accordance with a size of the received voltage includes changing the value of the lead angle when the received voltage is larger than the rated voltage.

* * * * *